US008446273B2

(12) United States Patent
Humphrey et al.

(10) Patent No.: US 8,446,273 B2
(45) Date of Patent: May 21, 2013

(54) ENVIRONMENTAL RISK MANAGEMENT SYSTEM AND METHOD

(75) Inventors: Christopher A. Humphrey, San Diego, CA (US); Ramon W. Rosati, Simsbury, CT (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 13/058,854

(22) PCT Filed: Aug. 14, 2009

(86) PCT No.: PCT/US2009/053873

§ 371 (c)(1),
(2), (4) Date: Feb. 12, 2011

(87) PCT Pub. No.: WO2010/019871

PCT Pub. Date: Feb. 18, 2010

(65) Prior Publication Data

US 2011/0133927 A1 Jun. 9, 2011

Related U.S. Application Data

(60) Provisional application No. 61/088,860, filed on Aug. 14, 2008.

(51) Int. Cl.
*G08B 1/08* (2006.01)
*G08B 23/00* (2006.01)

(52) U.S. Cl.
USPC ..... 340/539.11; 340/539.1; 340/539.13; 340/539.22; 340/539.26; 340/540; 340/601; 340/573.1; 340/539.12; 702/187; 128/903; 600/301; 455/404.1

(58) Field of Classification Search
USPC ..... 340/539.11
See application file for complete search history.

(56) References Cited

U.S. PATENT DOCUMENTS

| | | | | |
|---|---|---|---|---|
| 6,894,610 | B2 * | 5/2005 | Schubert et al. | 340/531 |
| 6,965,313 | B1 * | 11/2005 | Saylor et al. | 340/539.18 |
| 7,675,411 | B1 * | 3/2010 | Michaelis et al. | 340/539.12 |
| 7,830,249 | B2 * | 11/2010 | Dorneich et al. | 340/539.12 |
| 2006/0125623 | A1 * | 6/2006 | Appelt et al. | 340/521 |
| 2009/0174547 | A1 * | 7/2009 | Greene et al. | 340/539.13 |

* cited by examiner

*Primary Examiner* — Donnie Crosland
(74) *Attorney, Agent, or Firm* — Wood, Phillips, Katz, Clark & Mortimer

(57) ABSTRACT

A system and method for directing and monitoring the whereabouts of persons within an environmentally hazardous area includes equipping each person with devices for monitoring personal physiological conditions (56), equipment conditions (64), topographical locations (34), environmental conditions (57) and other pertinent data. The data are individually encoded and uploaded to a processing center (36) where they are analyzed (58,60,61) in order to ensure compliance with health or environmental norms and safety regulations, generate hot-spot mapping (53) and to issue real-time risk avoidance behavior directives (62), worker, mechanism and material traffic directions, warnings (59), permissions or interdictions.

20 Claims, 4 Drawing Sheets

ENVIRONMENTAL RISK MANAGEMENT SYSTEM AND METHOD

PRIOR APPLICATION

This application claims the benefit of U.S. Provisional Patent Application Ser. No. 61/088,860 filed 14 Aug. 2008.

FIELD OF THE INVENTION

The present invention relates to environmental systems used to survey, monitor, and direct personal activities within a hazardous area.

BACKGROUND

The prior art discloses a variety of environmental monitoring instruments and methods, notably patents and Publications No. U.S. Pat. No. 6,442,639 McElhattan et al.; US2006/0125623 Appelt et al.; US2006/0252999 Devaul et al.; and, U.S. Pat. No. 7,289,944 Genovese, which are incorporated herein by this reference.

Although the prior art discloses centralized analysis of data collected from individually carried physiological and environmental condition monitors, and fixed site monitors that can issue predictive warnings, it does not reveal any method or system for providing personalized instantaneous feedback information, instructions and directive in real-time to the individuals.

For example, in areas subjected to various types and degrees of radiation, it is desirable to direct an individual who has already been subject to a certain level of radiation away from an area that would cause exposure beyond regulatory safety limits, but along a safer path toward her allowed destination. Alternately, a recommendation could be issued regarding the use of some protective gear only when and as long as the hazardous condition persists. It would also be advantageous to inform the person at risk about how long she may safely remain on the dangerous site in view of her cumulative exposure history.

SUMMARY

The instant invention contemplates the monitoring and controlling of the whereabouts of individuals in a defined area subject to environmental hazards. Each individual is fitted with a set of portable sensors and detectors that are in constant communication with a data gathering and processing central installation. Depending upon the type of work site and the nature of environmental risks, the sensors and monitors may include person and equipment location sensors and trackers, personal physiological sensors capable of measuring the individual's temperature, pulse rate, blood pressure, blood oxygen level and other such parameters, equipment status sensors capable of measuring remaining battery life, filter core effectiveness and other such parameters, as well as local conditions such as ambient heat, noise level, air quality and a wide-spectrum of radiations from microwaves to infrared as well as x-rays and nuclear radiations.

The individual and/or equipment may also carry a transponder or RFID tag that responds to interrogating stations located throughout the area.

All monitoring data transmitted to the central installation are encoded with an asset identification which allows the installation to accumulate personalized information about each individual and piece of equipment. The collected data is analyzed in real-time and compared with historical data to detect current exposure, or other conditions that require the issuance of a warning, or an urgent alarm or a progress interdiction.

The analysis may include statistical calculations, fuzzy logic interpretations and vectorial trajectory predictions in order to anticipate eminent excessively dangerous conditions that require evacuation, rerouting of the individual's progression along a less hazardous path, the cessation of certain dangerous activities, or the use and effectiveness of personal protective equipment, and whether that equipment or its parts need replacing, maintenance or other intervention.

More specifically, the invention contemplates the user of the portable, battery-powered hazardous detection platform attached to each individual's body by means of a belt clip or clothes clip. Each detection platform includes several slots to plug in a number of sensors of various types described above. Fixed detection platforms dispersed throughout the work sites have sensors targeted toward environmental hazards. Examples of such sensors include, but are not limited to, toxic and flammable gas detectors, temperature and humidity gauges, noise dosimeters, radiation counters, and laser or other hazardous light detectors. The monitored hazard data are converted to a standard digital signal for ease of assessing the output of the sensor condition, and embedded into a standard signal format for ease of assessing and easy replacement of sensor types in a standard slot.

An optional display of various types of warnings and alarms (e.g., audible, visual or vibrating) alerts the wearer if a hazardous condition exists. A further extension of the alarm capability could be in-ear communication by short-range radio. Each portable detection platform is assigned a given individual identity, which is embedded in the data transmitted to the centralized installation. Similarly, each stationary platform provides a location indication.

The physical location of each individual will also be obtained, and continuously updated via ground position sensors or UWB radio, radio triangulations or some other method such as embedded sensors throughout the work area.

Data collected by the central installation is stored in a database for further processing.

Software routines are provided to analyze the collected data to produce a variety of information display such as:

Logs and graphs of individuals' exposure over time and individuals' physical condition;

Logs and graphs of specific equipment condition;

Logs of any warning or alarms encountered by the individual;

Logs and graphs of exposure for given place over time; and,

Physical location data tied to a visualization system allowing mapping of hotspots of various types within a plant or other facility.

In some embodiments there is provided a method for managing and monitoring the safe circulation of individuals within a hazardous area which comprises: providing at least one personalized condition monitor to at least one of said person, said monitor having means to communicate monitoring data; operating a processing center programmed for receiving and analyzing said data and for generating real-time directives to said person in response to said analyzing.

In some embodiments said generating comprises generating and issuing predictive warnings. In some embodiments said generating comprises generating and issuing worker behavior directions. In some embodiments said generating comprises generating and issuing worker, mechanism and material traffic directions. In some embodiments said providing comprises providing at least one physiological condition monitor. In some embodiments said providing comprises providing at least one environment condition monitor. In some embodiments said providing comprises providing at least one equipment condition monitor. In some embodiments said providing comprises providing at least one location monitor. In some embodiments said method further comprises providing a network of wireless communication stations dispersed throughout said area and a communication hub associated with said processing center.

In some embodiments there is provided a system for managing and monitoring the safe circulation of individuals within a hazardous area which comprises: at least one personalized condition monitor specific to at least one of said individuals, said monitor having means to communicate monitoring data; a processing center programmed for receiving and analyzing said data and for generating real-time directives to said at least one of said individuals in response to said analyzing.

In some embodiments the system further comprises at least one environment condition monitor. In some embodiments the system further comprises means for generating and issuing predictive warnings. In some embodiments the system further comprises means for generating and issuing worker behavior directions. In some embodiments the system further comprises means for generating and issuing worker, mechanism and material traffic directions. In some embodiments said condition monitor comprises at least one physiological condition monitor. In some embodiments said condition monitor comprises at least one equipment condition monitor. In some embodiments said condition monitor comprises at least one location monitor. In some embodiments the system further comprises a network of wireless communication stations dispersed throughout said area and a communication hub associated with said processing center. In some embodiments said monitoring data comprises data selected from the group consisting of: physiological data; equipment condition data; and, ambient environmental condition data.

DESCRIPTION OF THE EXEMPLARY EMBODIMENTS

Figure 1:
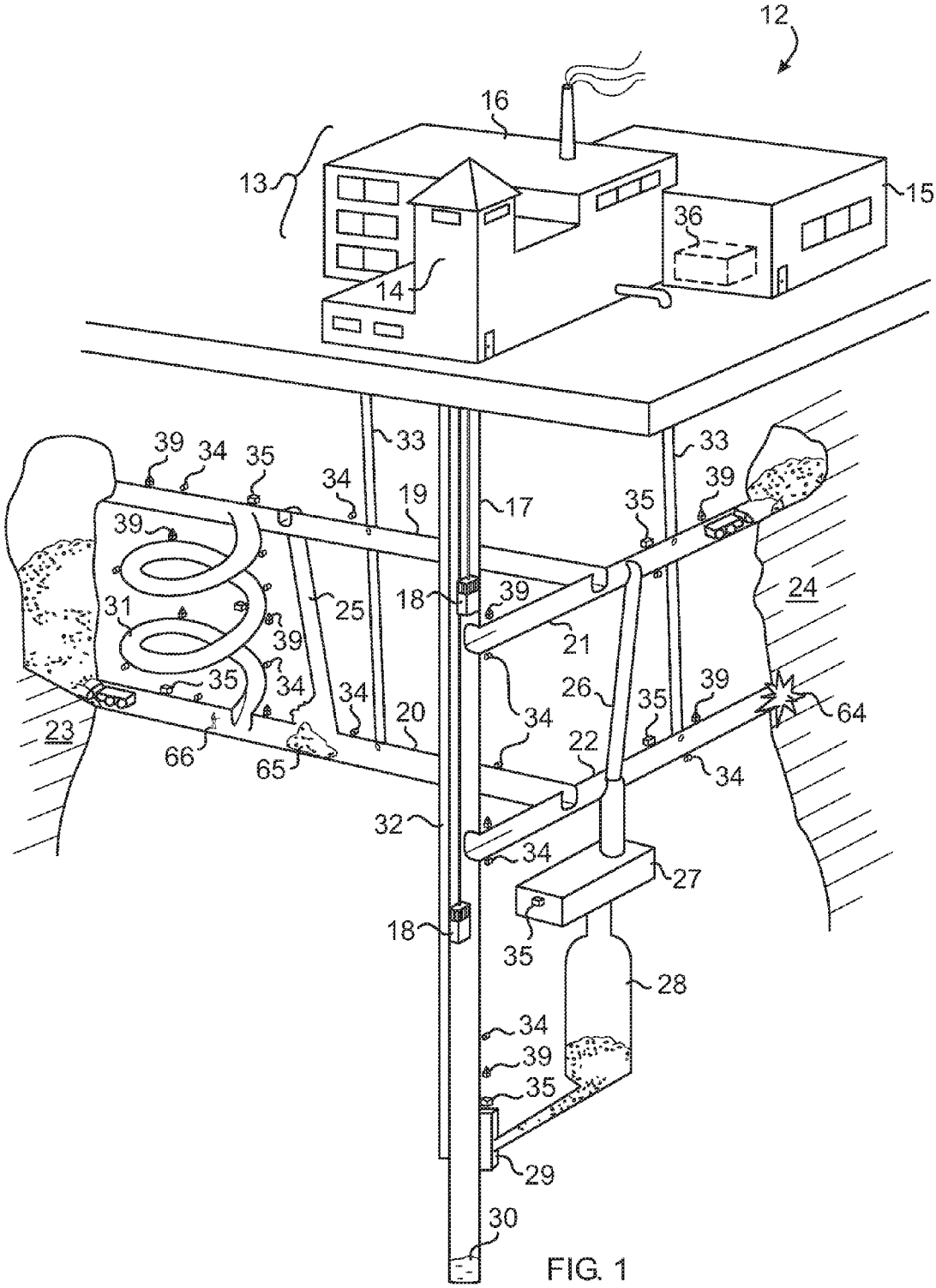
FIG. 1 is a diagrammatical representation of a typical underground mining complex equipped with risk management system according to the invention.

Referring now to the drawing, an embodiment of the Environmental Risk Management System and Method 11 will be described in connection with a mining operation 12 diagrammatically illustrated in FIG. 1.

The exemplary mining operation comprises in an aboveground facility 13 including a shaft, and skip operation control and ventilation tower 14, with a central management building 15 and an ore processing plant 16.

The underground installation comprises of a main shaft 17 in which rides one or more skips 18, several drifts 19-22 projecting horizontally form shafts into ore deposits 23, 24. Several ore passes 25, 26 are provided to dump the extracted material toward or into a crusher 27 mounted above an ore bin 28. The skip-loading station 29 is located in a lower portion of the shaft which is terminated by a sump 30. A spiral ramp 31 allows access from one of the drifts 19 to the one immediately below it 20. A utility shaft 32 houses all the wiring, cables, and ducts, including a water supply, and runs along side the main shaft 17. Vent pipes 33 bring forced air generated by the blowers in the shaft and skip control tower 14 down to the various drifts.

The security equipment includes interrogating and listening stations 34 installed about every 25 meters along the shafts, drifts, and ramps, frequented by working persons. These stations can interrogate and receive signals from RFID tags or transponders carried by assets including persons or equipment. Environmental multi-detectors 35 are permanently installed at various strategic locations throughout the mining network. These detectors measure the ambient temperature, humidity, dust concentration, and noise level. They also detect dangerous gases such as methane, carbon monoxide, and nitrous oxide that can result from improperly balanced blasting mixtures. Geiger counters and other radiation measuring devices may also be used to detect radon and gamma rays emitted by pockets of uranium ore. All the measurements are continuously sent via cables to a processing center 36 located in the central management building 15.

A wireless radio mesh communication network includes a plurality of nodes 39 having antennae capable of receiving wireless signals and re-transmitters to send those signals to other nodes and to the processing center, and are also positioned throughout the underground mining network.

Figure 2:
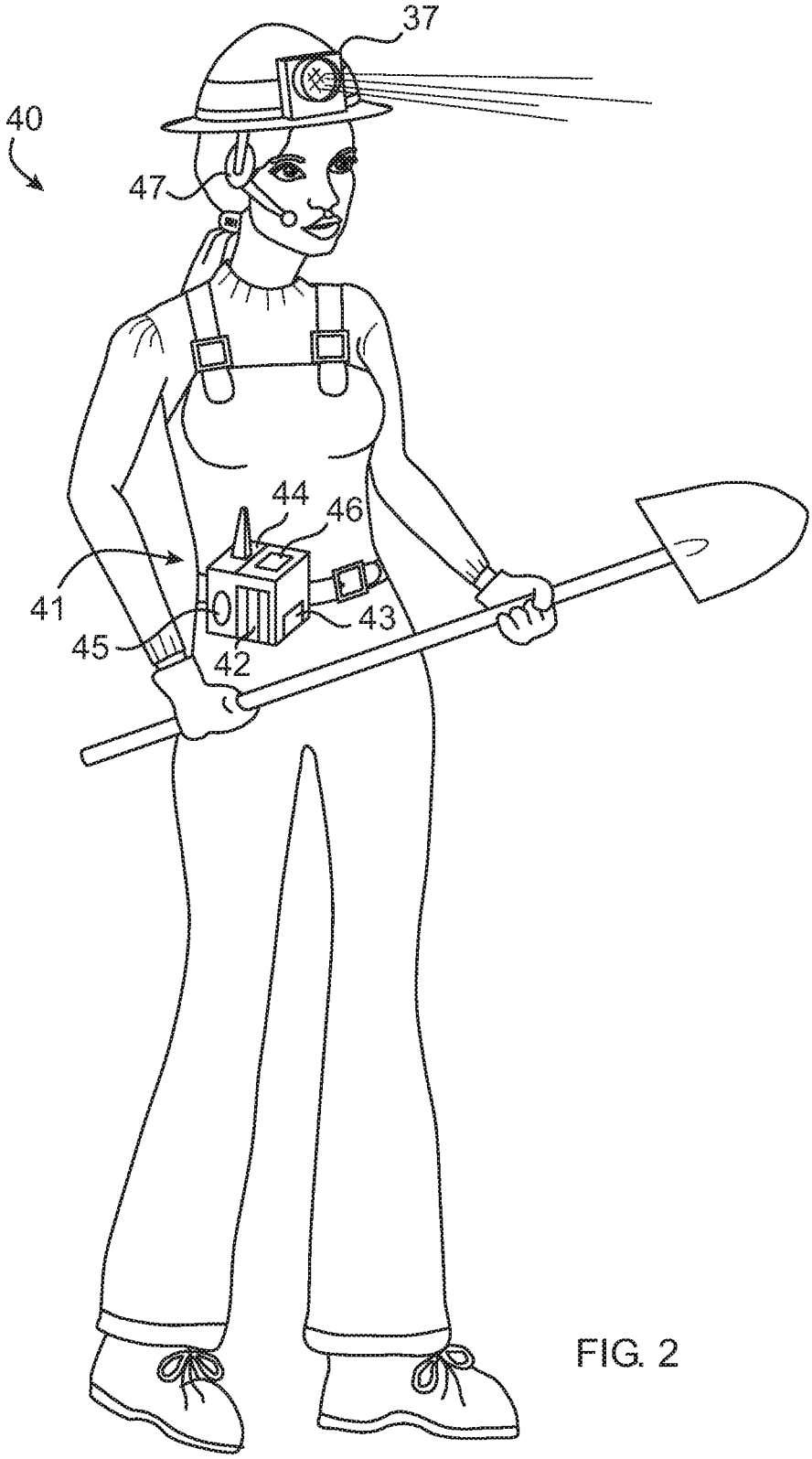
FIG. 2 is an illustration of a mining person equipped with a risk protection and monitoring gear.

As illustrated in FIG. 2, each person 40 working underground carries equipment such as a self-powered headlamp 37, filtered respirator mask (not shown) and a personal risk monitor 41 which is carried on the waistbelt. The personal risk monitor groups a plurality of physiological parameter measuring devices 42 used to monitor the temperature, skin moisture, heart rate, blood pressure, respiration rate, and blood oxygen level of the individual, and can also include environment sensors to monitor ambient oxygen or noise. Each piece of equipment and the risk monitor can include an RFID tag 43 which can respond to interrogation via the stations 34 to track location.

The personal risk monitor can include a wireless communication unit 44 in contact with the nearest communication node 39. The monitor can thus transmit data comprising the various measured physiological, environmental and equipment status parameters such as remaining battery or filter life. The monitor also includes a loud speaker 45 and a small LED readout 46 to display short messages. In the hazardous environments, the person can communicate via a microphone and earphone in her sound-protective headset 47.

The detection measurement of noxious gases may be accomplished with a use of a model PhD6 multi-gas detectors available from Sperian Instrumentation of Middletown, Conn. The measurements of blood pressure, blood oxygen level, respiration and heartbeat, can be accomplished by sensor mounting in a wrist cuff or glove.

It will be understood that a different environment may allow or require different types of instrumentation. For example, in an open air work site, detection of the topographical location of the worker may be accomplished through the use a GPS device or radio triangulation system. Communication between the individuals and the monitoring stations with the processing center may be accomplished by a cellular network or other wide-band radio equipment.

Figure 3:
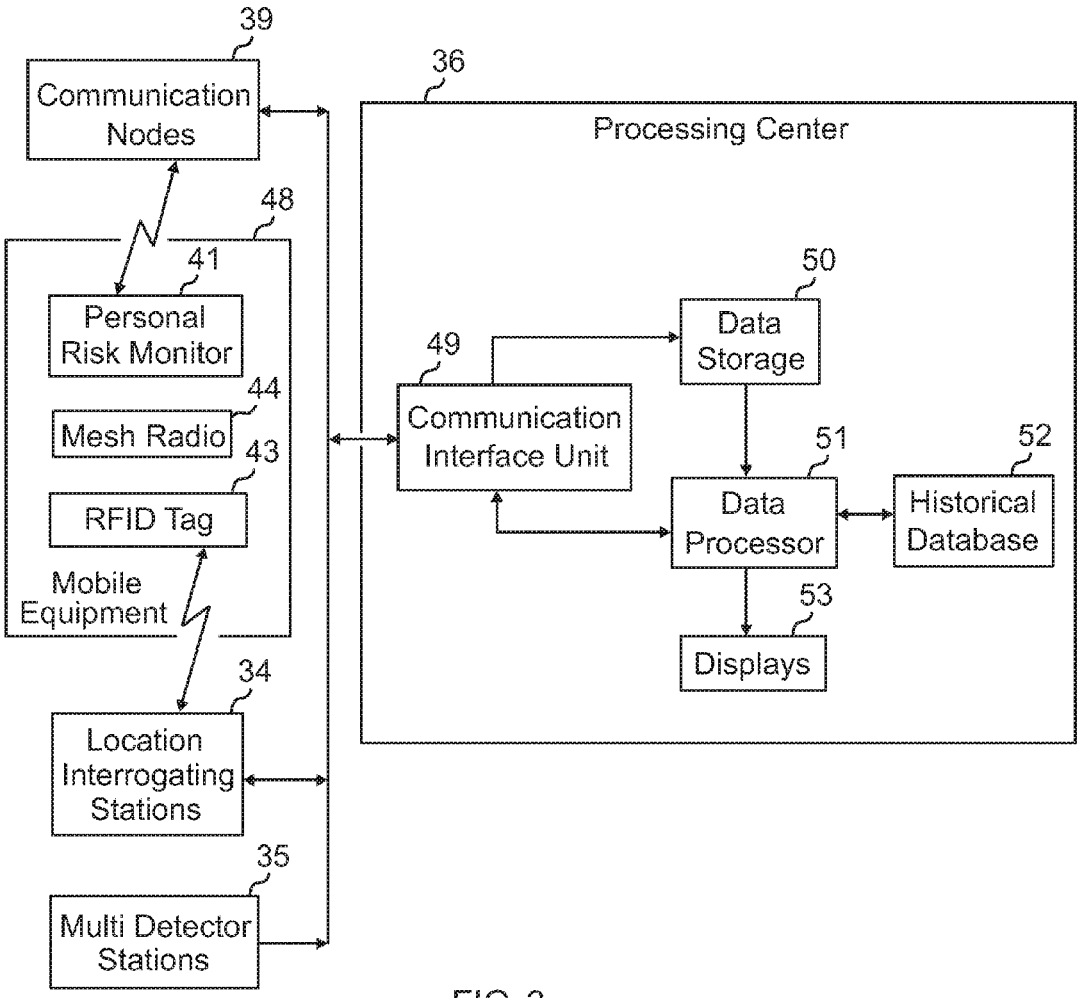
FIG. 3 is a block diagram of the overall system operation.

The overall risk management system layout is illustrated in the block diagram of FIG. 3. The mobile equipment carried by each person operating within the hazardous underground area 48, comprises her protective gear, the personal risk monitor 41 and mesh network radio 44 that are in wireless communication with one of the communication nodes 39. The RFID tag 43 communicates with the interrogation listening station 34. The communication node 39, location interrogating station 34, and multi-detector stations 35 are hard wired through the utility duct 32 to a communication interface unit 49 at the processing center. This unit directs the communication to the data storage 50 or to an automatic data processor 51. The data processor sorts and analyzes the incoming information including information transmitted by individual workers, equipment, or environmental sensors, and generates individualized historical records that are transferred to a historical database 52, as well as graphical and numerical displays 53.

Figure 4:
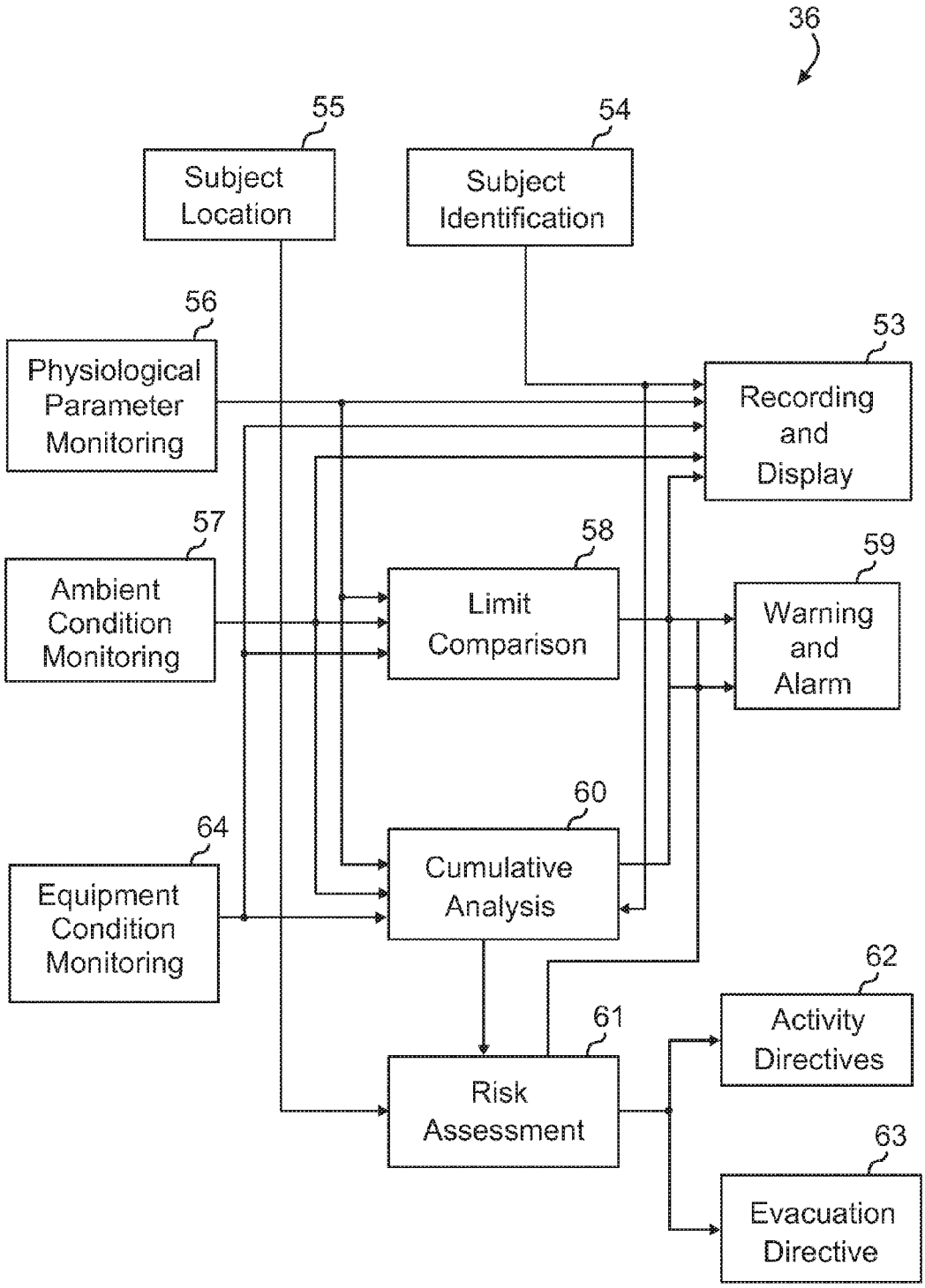
FIG. 4 is a block diagram of the processing center operation.

The operation of the processing center 36, as illustrated in FIG. 4, comprises several processing routines. First, the identification of each person and/or piece of monitored equipment in the monitored area is determined 54 as well as her or its exact location 55. This is done in response to the interrogation of RFID tags. Each person's physiological parameters are monitored 56 then recorded and displayed in various charts. Equipment condition such as location, availability, and effectiveness are similarly monitored 64 and recorded and displayed. The ambient conditions provided by the multi-detectors 35 are also monitored 57, recorded and displayed 53, and also checked against safety limits along with the physiological and equipment parameters. Maps of environmental hot spots are generated and displayed, and can be updated continuously with the latest received data and statistical analysis results. Any condition exceeding safety norms, triggers a warning or alarm 59. The physiological and equipment parameters and the ambient conditions are also subject to a cumulative analysis 60 in which results are recorded and displayed, and if necessary, trigger a warning or alarm. The results of the cumulative analysis 60 and limit comparisons 58 are fed to a risk assessment unit 61, which in turns generates activity directives 62 such as the interdiction of certain high risk areas, an order to put on protective gear, replace or change out worn or ineffective components, or an order for a period of rest and relaxation. Activity directives can also notify personnel, maintenance or inventory departments about the need some activity such as the training of more workers or ordering more equipment parts. In case of disaster, the risk assessment unit issues an evacuation directive 63. During blasting 64 which is likely to generate noxious gases, the entire workforce may be restricted to some distant locations of the underground network. In the event of a cave-in or collapse 65 causing the blockage of a drift 20, a worker 66 may be directed to evacuate via the ramp 31 to the next upper level drift 19.

The risk assessment unit 61 uses statistical calculations and fuzzy logic determinations to generate preventive directives, warnings, and recommendations, and define future periods of safe activity with an expected ambient condition. All directives are immediately and in real-time communicated to the individual workers, ushering the safest and yet most productive operation of the mining complex under the current circumstances.

For example, the person at risk is immediately provided the most up-to-date information about how long she may safely remain on the dangerous site in view of her cumulative exposure history, the current level of the hazard, the current effectiveness of her protective equipment, her current physiological condition, and the historical expectation of how and when the hazard will diminish. If her respiration rate is elevated and high concentrations of dust are present, the system could recommend that she use an air purifying mask. If the current effectiveness of that mask is inadequate given these parameters, a reassignment directive can be issued. If the historical statistics for the area show that the hazard is likely to diminish, the system could recommend an on-site rest period rather than reassignment. On the other hand, if the worker is reassigned, the system can identify the next closest and relatively available worker based on daily task schedules, and direct the available worker to take on the task. The system can also take into account productivity records for each individual, or groups of individuals who appear to work well together, and assign more productive individuals or groups to tasks which require more rapid completion.

It shall be understood that the above described system I scalable such that fewer components of the system can be implemented in a less complex setting. For example, a PC based system can monitor a group of tethered construction workers working on a scaffolding to verify that workers remain constantly tethered. Simple contact sensors on buckles, strain gauges on the tether lines can be collectively and individually monitored by the system to ensure compliance with safety rules. Historical analyses and tracking can determine whether a particular tether needs replacing.

While the exemplary embodiments of the invention have been described, modifications can be made and other embodiments may be devised without departing from the spirit of the invention and the scope of the appended claims.

What is claimed is:

1. A method for managing and monitoring the safe circulation of individuals within a hazardous area which comprises:

providing at least one environmental condition monitor for measuring an environmental parameter associated with a hazard at a site;

providing at least one physiological condition monitor to at least one of said individuals, namely a worker;

said physiological condition monitor being adapted to measure a physiological parameter associated with exposure of said worker to said hazard;

providing at least one piece of protective equipment to said worker, said equipment being adapted to diminish the physiological effect of said hazard upon said worker;

scheduling said worker to enter said site containing said hazard;

maintaining a historical database of monitored data comprising:

historical measurements of said physiological parameter associated with said worker;

historical measurements of said environmental parameter associated with said hazard at said site; and, historical measurements of an equipment parameter associated with said piece of protective equipment; and, analyzing said historical database of monitored data to obtain:

a current effectiveness condition of said piece of equipment;

a current physiological condition for said worker;

a current hazard level condition in said site;

assessing said obtained conditions to determine a risk;

generating a real-time directive to said worker in response to said risk.

2. The method of claim 1, wherein said generating comprises generating and issuing predictive warnings.

3. The method of claim 1, wherein said generating comprises generating and issuing worker behavior directions.

4. The method of claim 1, wherein said generating comprises generating and issuing worker, mechanism and material traffic directions.

5. The method of claim 1, wherein said historical measurements of physiological parameter and said historical measurements of said environmental parameter comprise readings taken by a personalized condition monitor.

6. The method of claim 1, wherein:

said hazard is dust;

said environmental parameter is airborne dust concentration;

said physiological condition monitor is a breathing monitor;

said physiological parameter is respiration rate;

said protective equipment is an air purifying mask;

said equipment parameter is filter core effectiveness; and, said directive is an order to rest for a period.

7. The method of claim 1, wherein said providing at least one piece of protective equipment comprises providing at least one equipment condition monitor associated with said at least one piece of protective equipment.

8. The method of claim 1, wherein said method further comprises providing at least one location monitor for tracking a location of said worker.

9. The method of claim 1, which further comprises operating a processing center programmed for said maintaining, said analyzing, said assessing, and said generating.

10. The method of claim 1, which further comprises providing a network of wireless communication stations dispersed throughout said site and a communication hub associated with a processing center conducting said analyzing.

11. The method of claim 1, wherein said analyzing said monitored data further comprises analyzing said monitored data to obtain an historical expectation condition of when said hazard will diminish.

12. The method of claim 1, which further comprises generating a directive to a maintenance department to maintain said at least one piece of protective equipment.

13. The system of claim 1, wherein said real time directives include predictive warnings.

14. The system of claim 1, wherein said communication interface includes a network of wireless communication stations dispersed throughout said site and a communication hub associated with said processing center.

15. The system of claim 1, wherein said processing center is adapted to analyze said monitored data to obtain an historical expectation condition of when said hazard will diminish.

16. The system of claim 1, wherein said processing center generates a directive to a maintenance department to maintain said at least one piece of protective equipment.

17. A system for managing and monitoring the safe circulation of individuals within a hazardous area which comprises:

at least one environmental condition monitor for measuring an environmental parameter associated with a hazard at a site;

at least one physiological condition monitor for at least one of said individuals, namely a worker, said physiological condition monitor being adapted to measure a physiological parameter associated with exposure of said worker to said hazard;

at least one piece of worker protective equipment, said equipment being adapted to diminish the physiological effect of said hazard upon said worker;

a processing center remote from said hazardous area adapted to:

receive monitored data from said condition monitors, maintain a historical database of said received monitored data including:

historical measurements of said physiological parameter associated with said worker, historical measurements of said environmental parameter associated with said hazard at said site; and, historical measurements of an equipment parameter associated with said piece of protective equipment, analyze said historical database of monitored data to obtain:

a current effectiveness condition of said piece of equipment, a current physiological condition for said worker, and a current hazard level condition in said site, assess said obtained conditions to determine a risk, and generate a real-time directive to said worker in response to said risk; and a communication interface with at least one communication node for sending and receiving monitored data and real-time directives between the worker and the processing center.

18. The system of claim 17, wherein said real-time directives include worker behavior directions.

19. The system of claim 17, wherein said real time directives include worker, mechanism and material traffic directions.

20. The system of claim 17, wherein:

said hazard is dust;

said environmental parameter is airborne dust concentration;

said physiological condition monitor is a breathing monitor;

said physiological parameter is respiration rate;

said protective equipment is an air purifying mask;

said equipment parameter is filter core effectiveness; and, said directive is an order to rest for a period.

* * * * *